US005381957A

United States Patent [19]

Bianco

[11] Patent Number: 5,381,957

[45] Date of Patent: Jan. 17, 1995

[54] WATER/AIR MIXING AND DISPENSING DEVICES

[76] Inventor: Eric L. Bianco, 41 Lakeview Ave., Watchung, N.J. 07060

[21] Appl. No.: 181,613

[22] Filed: Jan. 13, 1994

[51] Int. Cl.[6] ..... B05B 1/08; B05B 7/00

[52] U.S. Cl. ..... 239/99; 239/71; 239/428.5; 239/432; 239/552

[58] Field of Search ..... 239/71, 99, 101, 428.5, 239/432, 552

[56] References Cited

U.S. PATENT DOCUMENTS

| | | | |
|---|---|---|---|
| 2,447,123 | 8/1948 | Jones . | |
| 2,744,738 | 5/1956 | Hjulian | 239/428.5 |
| 2,998,928 | 9/1961 | Aghnides . | |
| 3,322,352 | 5/1967 | Alcantara | 239/428.5 |
| 3,430,823 | 3/1969 | Hunsaker . | |
| 3,633,824 | 1/1972 | Aghnides | 239/428.5 |
| 3,708,125 | 2/1973 | Patterson | 239/428.5 |
| 3,762,648 | 10/1973 | Deines et al. . | |
| 3,796,377 | 3/1974 | O'Hare | 239/428.5 |
| 3,801,019 | 4/1974 | Trenary et al. . | |
| 4,072,270 | 2/1978 | Harmony | 239/428.5 |
| 4,082,225 | 4/1978 | Haynes | 239/428.5 |
| 4,190,207 | 2/1980 | Fienhold et al. . | |
| 4,202,501 | 5/1980 | Haynes | 239/428.5 X |
| 4,303,201 | 12/1981 | Elkins et al. . | |
| 4,330,086 | 5/1982 | Nysted | 239/428.5 X |
| 4,346,844 | 8/1982 | Harmony . | |
| 4,426,040 | 1/1984 | Smith | 239/428.5 |
| 4,530,467 | 7/1985 | Bueno | 239/428.5 X |
| 4,561,593 | 12/1985 | Cammack et al. . | |
| 4,573,639 | 3/1986 | Logue | 239/428.5 |
| 4,869,103 | 9/1989 | Jerman | 239/428.5 X |
| 5,111,994 | 5/1992 | Gonzalez | 239/428.5 |
| 5,154,355 | 10/1992 | Gonzalez | 239/428.5 |
| 5,265,803 | 11/1993 | Thayer | 239/71 |

*Primary Examiner*—William Grant

*Attorney, Agent, or Firm*—David, Littenberg, Krumholz & Mentlik

[57] ABSTRACT

A water/air mixing and dispensing device connected to a source of water has a housing with an elongated chamber end to end therethrough defining a shaped and sized mixing chamber and an operatively associated expansion chamber in communication with the mixing chamber, the housing having an inlet orifice connected at one end with the source of water and at the opposite end remote from the inlet orifice a transverse partition with spaced and sized openings against which the entering water impinges for drawing ambient air through the partition and for discharging the water/air mixture from the housing. The device may include a transverse rod in the elongated chamber of the housing for operative association with the transverse partition to modify the characteristics of the water/air mixture delivered and a plastic sleeve about the housing for various objects and commercial purposes.

5 Claims, 4 Drawing Sheets

WATER/AIR MIXING AND DISPENSING DEVICES

This invention relates generally to water/air mixing and dispensing devices, and more particularly to water-/air mixing and dispensing devices which meet the demands for conserving water without sacrificing the advantages, perceptions and effectiveness of free flowing water delivered at conventional system pressures.

BACKGROUND OF THE INVENTION

With the increase in individuals' and businesses' demands on the water supply, conservation of water has become a top priority in many locales. However, while numerous attempts have been made to create efficient water-conservation devices, and particularly cleaning devices using a water/air mixture, most of the attempts are unsatisfactory because of a number of common problems.

One such problem is that decreasing the flow of water by adding air for mixing with the incoming water often diminishes the effectiveness of using the water as a washing or cleaning tool. Further, even if a decrease in water flow does not actually adversely affect the efficiency of a cleaning device, people often perceive the need for more water anyway. For example, while many people could use a low-volume shower head to keep clean, they desire the feel of a high-volume, high-pressure shower.

Further, many water/air conservation devices are subject to mechanical failure. Either they have too many moving parts, are easily susceptible to clogging, or are subject to wear due to the corrosive effect of flowing water. The use of very fine water exhaust holes is also extremely susceptible to clogging due to lime and/or sediment deposits or other contaminants in the water.

Previous attempts include U.S. Pat. No. 3,322,352, which is directed to a sprayer for a shower head which uses a venturi effect. The shower head of that reference has an inlet for water which communicates with a tubular extension, and a sphere within the extension. In use, water passes through the inlet, meets the sphere, and causes a depression which pulls air through a passage from the atmosphere which communicates with tubular extension 5. The air mixes with the water and then passes to a larger section, which reduces the pressure of the water and "softly" projects the liquid over a central concave zone, and finally through holes disposed at the edges of the concave zone.

U.S. Pat. No. 5,154,355 also discloses a shower head. Water enters an inlet, and as it passes through the inlet, the water draws air from passages near the inlet. The passages are solely dedicated to the purpose of allowing air to mix with water from the inlet. After passing out of the inlet, the water and air enters a larger chamber where it expands, slows down to lose exhaust velocity, and is then passed out through perforations in the bottom of the shower head.

Consequently, there is a need for a water/air mixing and distributing device which conserves water, has a long mechanical life, is effective for cleaning, maintains the perception of a high-volume sprayer, and effectively increases the velocity of the exhausting water being supplied.

SUMMARY OF THE INVENTION

Thus, the present invention covers an improved water/air mixing and distributing device having, a housing with an elongated passage means extending end to end therethrough which defines, a mixing chamber and an operatively associated expansion chamber in communication with said mixing chamber, the said mixing chamber has a predetermined size and shape, the housing has a sized inlet orifice connected at one end to a source of water and at the outlet end disposed to deliver a predetermined volume of water which flows in a stream through the said mixing chamber and expansion chamber, and a partition means at the end of said housing remote from the inlet orifice against which the stream of entering water impinges, and said partition means includes, a plurality of spaced openings to enable the impinging water which produces a powerful vacuum or lower pressure to draw ambient air into the expansion chamber for mixing with said entering water and for discharging the water air/mixture from said housing.

DETAILED DESCRIPTION OF THE PREFERRED EMBODIMENT

Figure 1:
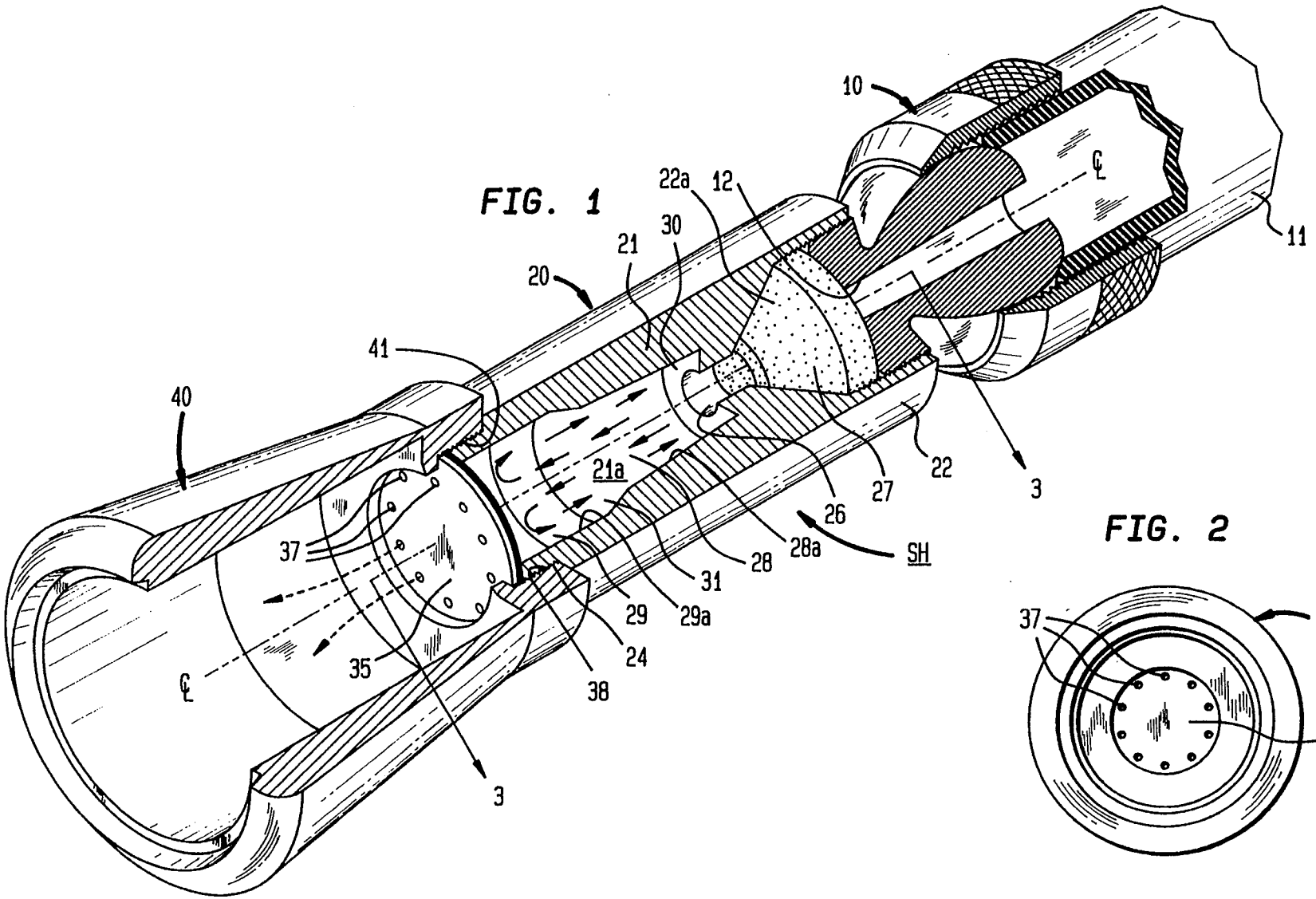
FIG. 1 is a perspective view of a preferred form of water/air mixing and distributing device in accordance with the invention partly in vertical section.
Figure 3:
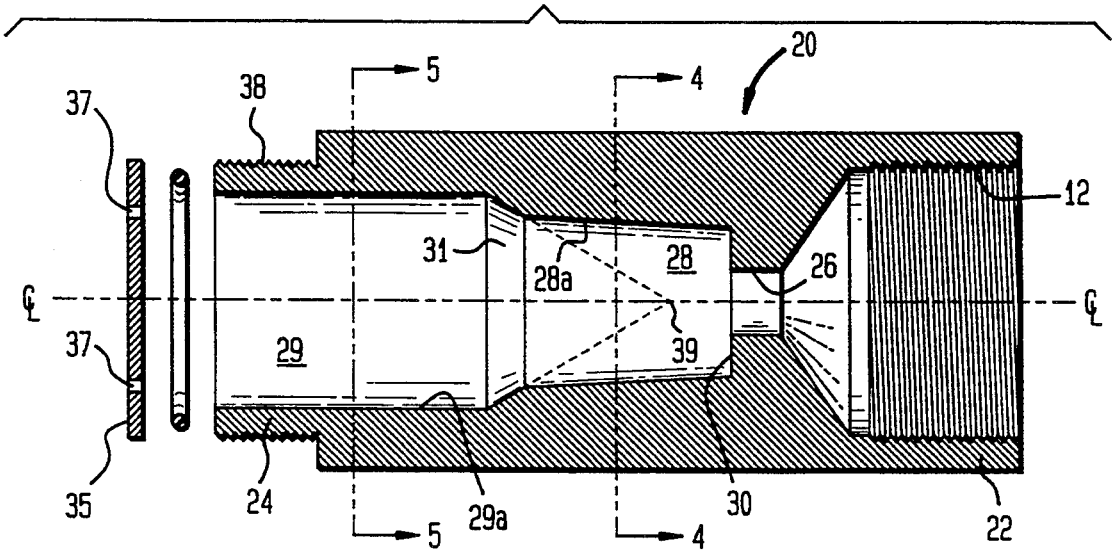
FIG. 3 is a longitudinal cross-section taken on line 3—3 of FIG. 1.

As shown in FIGS. 1 and 3, a system for mixing air with water is illustrated for use as a shower head generally SH. The shower head SH includes, a ball type swivel joint 10, a water/air mixing cartridge generally designated 20, and a flow directing device generally designated 30.

The ball type swivel joint 10 is threadably connected to a conventional shower inlet pipe 11 which provides a suitable source of ambient water at conventional pressures in a range between 35 psig and 60 psig. The ball swivel joint 10 is a conventional member and has a bore 12 therethrough in communication with and to receive incoming water from shower head inlet pipe 11. Bore 12 preferably has #25 inner diameter equivalent to a diameter of 0.150" all of which is shown in FIG. 1.

For ease of reference, directions are stated in the description which follows, with respect to the longitudinal axis which extends along the longitudinal center of the water/air mixing cartridge 20. Thus, when used herein, the terms "axial" and "axially" should be understood as referring to the direction parallel to this longitudinal axis, whereas the terms "radial" and "radially" should be understood as referring to the directions transverse to this axis. The term "radially inward" refers to the direction towards the longitudinal axis, whereas the term "radially outward" refers to the direction away from the longitudinal axis. In addition, if a first point is referred to as being "above" a second point, then the first point is closer along the axial direction to top end 22 of the water/air mixing cartridge 10 than the second point. Likewise, if a first point is referred to as being "below" a second point, then the first point is closer along the axial direction to the bottom end 24 of the mixing cartridge 20 than the second point.

As further defined herein, the angle between the sides or walls of a chamber or space and the said longitudinal axis is found by measuring the angle between the longitudinal axis and the intersecting plane of that portion of the side of the chamber which extends through the plane of the longitudinal axis.

Water/air mixing cartridge 20 is threadably connected by suitable threaded means to the end of the ball swivel type joint 10 as at 12 and includes a generally elongated cylindrical housing 21 of the water/air mixing cartridge 20. Proximate to top end 22, the housing 21 is threaded inwardly for a predetermined axial distance along top end 22. Preferably, this predetermined axial distance along end 22 is about 3/16".

Starting at this predetermined distance along top end 22, the housing 21 begins tapering as at **22*a* to a small aperture identified as entering water inlet 26. A beveled rubber washer 27 is seated in the tapered portion 22*a* at the top portion of the housing 21** to provide a fluid-tight seal.

The entering water inlet 26 is a sized opening disposed in the longitudinal axis, and preferably has a diameter of about 0.150". This inlet for incoming water is so sized because it is significant to the advantageous function of the water/air mixing cartridge in accordance with the present invention to conserve water.

The housing 21 has a generally elongated chamber **21*a* which defines a mixing chamber 28 and an expansion chamber 29. Mixing chamber 28 is immediately adjacent to and communicates with entering water inlet 26. It extends a predetermined axial distance from entering water inlet 26 and is conical and tapers radially outward so that the radial distance between longitudinal axis and the walls or sides 28*a* of mixing chamber 28 increase with increasing distance from entering water inlet 26. Preferably, the rate of increase for the outwardly tapering walls 28*a* of the mixing chamber 28 is constant. For example, it is desirable for the angle between walls or sides 28*a* of the mixing chamber 28 and longitudinal axis for the water/air mixing cartridge 20** to be about 6°.

Figure 4:
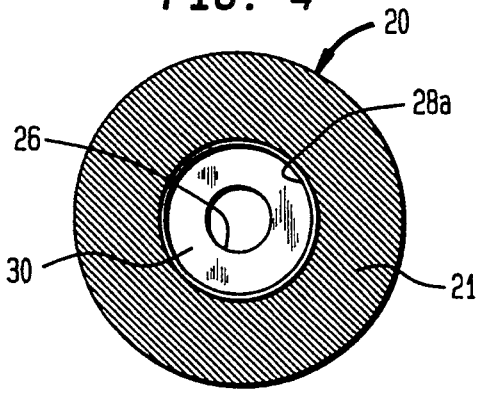
FIG. 4 is a transverse cross-section taken on line 4—4 of FIG. 3.

The end of the walls **28*a* of the mixing chamber 28 adjacent to the entering water inlet 26 is a spaced distance radial outwardly from the longitudinal axis and thus forms an annular end wall as at 30 about the inlet 26, all of which is clearly shown at FIGS. 1, 3 and 4** of the drawings.

Figure 5:
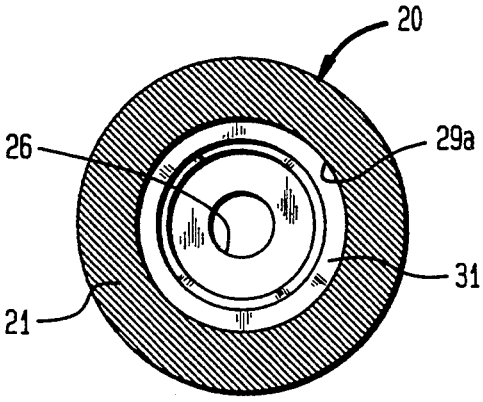
FIG. 5 is another transverse cross-section taken on line 5—5 of FIG. 3.

At the opposite end of the tapered walls **28*a* of the mixing chamber 28, a predetermined distance from the annular end wall 30, the walls of the elongated passage 21*a* taper radially outwardly at a sharp angle to form a flange or shoulder as at 31 to the longitudinal axis which dramatically increases as these walls extend further from the annular end wall 30. By way of example, the taper of walls for the flange or shoulder 31 changes from about 6° to about 30°. As with the mixing chamber 28, flange or shoulder 31 tapers radially outward with respect to the longitudinal axis and preferably increases at a constant rate with increasing distance from the entering water inlet 26, as is also shown in FIGS. 1, 3 and 5** of the drawings.

Beyond this flange or shoulder 31, mixing chamber 28 communicates with the expansion chamber 29 with which it is operatively associated as hereinafter described.

Expansion chamber 29 freely communicates with and is in general alignment with mixing chamber 28. The upper end of the walls **29*a* of the expansion chamber 29 is connected to the flange or shoulder 31. While the walls of the mixing chamber 28 are conically tapered, the walls 29*a* of the expansion chamber 29 are preferably uniform and in the shape of a right circular cylinder. Therefore, the walls 29*a* defining the expansion chamber 29 have a generally constant radial distance outwardly of the longitudinal axis for the water/air mixing cartridge 20**.

The elongated chamber **21*a* in the water/air mixing cartridge 20 and housing 21 has a predetermined length of about 1". The relationship between the sizes and shapes of the respective mixing chamber 28, flange or shoulder 31 and expansion chamber 29 affects the operation of the invention, as is described more particularly below. For the embodiment shown in FIGS. 1 to 5 of the drawings, the desired sizes are such that: the radial distance of the annular end wall 30 to the longitudinal axis of the water/air mixing cartridge 20 is about 0.150". Thus, the diameter of the annular end wall 30 is about 0.300"; the longitudinal length of mixing chamber 28 from entering water inlet 26 to flange or shoulder 30 is about 0.625"; the longitudinal length of shoulder 30 from the bottom end of mixing chamber 28 to the top end of expansion chamber 29 is about 0.375"; the axial length of expansion chamber 29 from flange or shoulder 30 to bottom end 24 of the elongated chamber 21*a* is about 0.375"; and the diameter of expansion chamber 29** is about 0.500".

Figure 2:
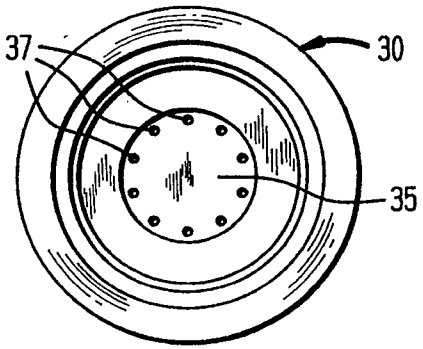
FIG. 2 is a bottom view of the water/air mixing add distributing device as shown in FIG. 1.

Below expansion chamber 29, and disposed at the bottom end 24 of the water/air mixing cartridge 20, is a closure or partition 35, as shown in FIGS. 1 and 2. Partition 35, while substantially closing off the expansion chamber 29, is perforated, such that a plurality of generally circumferentially spaced holes 37 permit entry or flow of air from the ambient atmosphere into and a mixture of water and air out of expansion chamber 29 to the ambient atmosphere. As further shown in FIGS. 1 and 2, there are ten circumferentially spaced holes disposed inwardly of the periphery of partition 35, each hole preferably having a diameter of about 0.036".

While the spaced holes 36 are shown in circumferential alignment, they may also be randomly spaced in respect of the periphery, and of varying sizes and a smaller or larger number of such sized holes may be used as operating conditions may require or dictate depending on the particular application or use for the water/air distributing device in accordance with the present invention, without departing from the scope thereof.

With respect to the outer dimensions of water/air cartridge 20 which may vary within designs or other functional aspects of the water/air mixing and distributing device in accordance with the present invention and which do not affect the sizes of the above described mixing and expansion chambers, the outer diameter of the cartridge is about 0.750". However, as shown in FIGS. 1 and 3, the diameter of the outer surface of cartridge 20 at bottom end 24 is less than the diameter of the cartridge 20 elsewhere. For an axial distance of about 0.675" from bottom end 24, the diameter of the outer surface of cartridge 20 is about 0.625" and is threaded as at 37 for about 3/16" to provide a connection for the flow distributor 40 which aids in directing the flow of the water/air mixture discharged through the spaced holes 36 from the expansion chamber 29.

Distributor or shower horn 40 is hollow and generally conical, and has an upper threaded portion 41 for connecting the shower horn to the threaded outer section 37 at bottom end 24 of the cartridge 20 for the water/air mixing and dispensing device SH in accordance with the present invention.

Operation of the Embodiment Shown in FIG. 1

In operation, inlet water pipe 11 provides a source of water at about 60 psig. The arrows shown in FIG. 1 illustrate the path or stream of water flow through the mixing chamber 28 and the expansion chamber 29 mixing water/air cartridge 20 or housing 21 of the water-/air mixing and distributing device SH in accordance with this embodiment of the invention.

Thus, water enters through inlet water pipe 11 into the ball swivel joint 10, base 12 and then through the sized entering water inlet 26. Due to the restricted size of the entering water inlet 26, the water passes into mixing chamber 28 at a high velocity and high pressure. This high pressure, high velocity stream of water continues through mixing chamber 28 and expansion chamber 29 until it impinges against partition 35. The impinging water is in substantial part turned backwards in a reverse direction and away from partition 35, although some of the water does pass through the spaced holes at 37 in the partition 35. The water which is turned back causes a strong reduction in pressure in expansion chamber 29 which acts to draw air through the spaced holes 37 in the partition 35 to form a water/air mixture in the expansion chamber 29 where the sized expansion chamber 29 enables this water/air mixture to expand. Due to the continued introduction of water into expansion chamber 29 the combination of entering water and expanding water and air gradually forces the water/air mixture upwardly into mixing chamber 28.

Because of tapered configuration of the walls 28*a* of the mixing chamber 28, the air in water/air mixture is compressed as the expanding water/air mixture is forced into the mixing chamber 28 which pressure increases to a maximum at the top portion of the mixing chamber 28 near entering water inlet 26. This now high-pressure compressed water/air mixture acts to momentarily impede the stream of water passing through entering water inlet 26, and mixing chamber 28. Within a short period of time, in micro-seconds, after the incoming stream of water is thus impeded, the pressure will build up until it momentarily overcomes the pressure of the water/air mixture at the top of mixing chamber 28. Thereafter water again entering through the entering water inlet 26 mixes with the water/air mixture already present in mixing chamber 28, and some of the water-/air mixture is then forced into the expansion chamber 29 and out through the spaced holes 37 in the partition 35.

Since the water/air mixing and distributing device SH in accordance with the present invention has no moving parts, this is a dynamic and recurring condition and repetition of the action of the pressurized water/air mixture at the top of mixing chamber 28 near entering water inlet 26 will continue to shut down the entering water to produce an oscillating effect as further water is introduced into the mixing chamber 28. This oscillating action produces corresponding pulsations in the water discharged from the expansion chamber 29 through the spaced holes 37.

Effectively, a pulsating discharge of aerated water passes through partition 35 and is guided by distributing member 40 in the desired direction.

Such an effect results in a number of advantages. First, the invention is extremely efficient in conserving water in that only about 2.1 gallons of water are exhausted at about 60 psig.

Second, while the invention uses little water, the heavy aeration of the water is very effective for cleaning purposes. Due to the compressed air within the water/air mixture leaving the water/air mixing cartridge 20, an effervescent-like quality is created which produces a scrubbing effect.

This scrubbing effect also contributes to the sensation of more water being used than is actually expended. The user experiences the sensation of a wind-swept rainstorm as the water/air mixing and dispensing device SH in accordance with this form of the invention does not feed water in a steady unbroken stream, but rather feeds the water in a swarm of pulsating effervescent-like droplets that expand when they strike the user's body. In addition, due to the expansion/contraction or pulsating nature of the water/air mixture, the passage of hot water through the cartridge 20 and distributor 40 results in large volumes of relatively low temperature steam or mist, further simulating a wind-swept rainstorm.

Since the water/air mixing and distributing device in accordance with the present invention has no moving parts, the water/air mixing cartridge 20 is capable of withstanding a great deal of physical abuse and has a long service life. Further, because there are so few parts, the entire assembly including the water/air mixing cartridge 20 is easy to manufacture at very low production costs for materials and labor.

Thus, the preferred embodiment of FIG. 1 provides an excellent water-conserving shower head or nozzle device at relatively little expense while providing a very effective and satisfying shower and scrubbing device.

Varying the dimensions of the mixing chamber, shoulder, and expansion chamber may have dramatic effects on the characteristics of the water/air mixture being discharged or dispensed from the device. For example, if the axial length of the expansion chamber 29 is increased relative to the mixing chamber 28, less air is drawn through the spaced holes 37 in the partition 35, and the resultant output of water is less aerated. If the relative axial length of the expansion chamber 29 is decreased, then the resultant water/air mixture dispensed is more aerated.

Similarly, increasing or decreasing the diameter of the entering water inlet 26 will result in lesser or greater aeration, respectively. Assuming the dimensions of the chambers remain at the values set forth above, the preferable range of diameters for the entering water inlet 26 is between 0.120" and 0.150".

Further, the angles of the tapered or conical walls 28*a* of the mixing chamber 28 and the flange or shoulder 30 may also be varied while preserving the advantageous operation and efficiency as above described. For example, rather than using a chamber with fixed angles between the mixing chamber 28, shoulder 31, and expansion chamber 29, it is contemplated that all of the chambers could be defined by a long continuous curve. For example, mixing chamber 28 and shoulder 31 could be combined into a single parabolic-like curve which has a long gradual incline ending with a continuous but sharply angled turn.

While all of the angles and dimensions may be varied, it is desirable to maintain a given ratio between the diameter of the mixing chamber, the diameter of the expansion chamber, and the angle of the shoulder.

For example, if the diameter of mixing chamber 28 at the annular end wall 30 is 0.300", and the diameter of expansion chamber 29 is 0.500" then the diameter of the walls 28*a* of the mixing chamber inwardly of the flange or shoulder 31 should be 0.400". In other words, if the angle of the flange or shoulder 31 is extended upwardly towards top end 22 of the water/air mixing cartridge 20, a continuation of this angle will intersect the longitudinal axis at a point 39 within the mixing chamber 28. If the radial distance from point 39 to the walls 28*a* of mixing chamber 28 is 0.200", the diameter of the mixing chamber 28 at this point will be 0.400". This ratio of 0.300":0.400":0.500" (3:4:5) equal to (mixing chamber diameter at inlet):(mixing chamber diameter at the intersection of longitudinal axis with angle of shoulder):(expansion chamber diameter) has been found extremely effective in creating an output with a proper balance of water, air, pulsation, velocity, volume and pressure, especially when used in conjunction with a 6° angle of taper for the mixing chamber 28.

The 3:4:5 ratio should be maintained even if the angle of the flange or shoulder 31 is changed. In other words, no matter what the angle of the flange or shoulder 31, the angle of the shoulder should point to the spot on the longitudinal axis for the cartridge where the diameter of mixing chamber 28 is 0.400". For instance, if the angle of the flange or shoulder 31 is decreased to 15°, then the intersection point 39 will be closer to top end 22. Accordingly, the axial length of mixing chamber 28 from annular end wall 30 to the flange or shoulder 31 will be increased so that intersection point for the angle of the tapered or conical walls 28*a* of the mixing chamber 28 still occurs where the diameter of the walls 28*a* of the mixing chamber 28 is 0.400".

A sharper or greater angle than 45° tends to produce violent pulsations which affect the desirable sensitiveness of the water/air mixing and dispensing device as shown in FIGS. 1 to 5 of the drawings. Therefore, a more gradual angle of about 30° is preferred for the flange or shoulder 31.

Figures 6, 7:
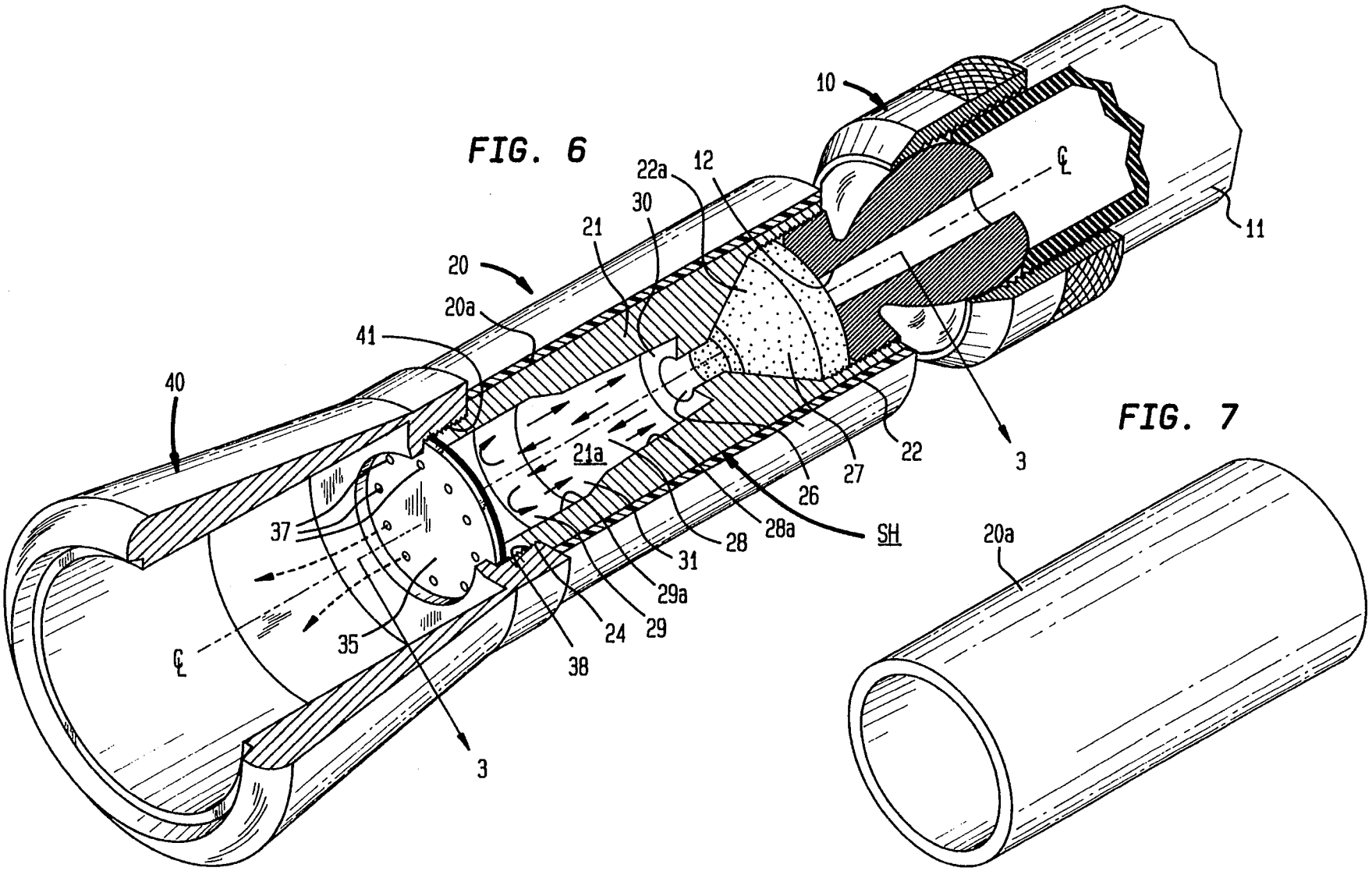
FIG. 6 is a perspective view of the form of the water-/air mixing and distributing device shown in FIG. 1 broken away in vertical sections to show a decorative or identifying sleeve mounted about the water/air mixing cartridge portion.
FIG. 7 is a perspective view of just the decorative or identifying sleeve shown in FIG. 6.

In FIGS. 6 and 7, the water/air mixing and dispensing device is identical to the embodiment shown in FIGS. 1 to 5 of the drawings. It differs only to the extent that a removable and replaceable sleeve as at 20*a* is provided about the outer surface of the water/air mixing cartridge 20.

Sleeve 20*a* may be made of a synthetic plastic or other waterproof material and can be colored or decorated with a pattern or numbers and can serve a variety of purposes; for example, it can be used for inventory controls or with decorations or numbers thereon as a trademark for identifying the origin or source of the seller in the commercial marketplace.

Another Embodiment of the Invention

Figure 8:
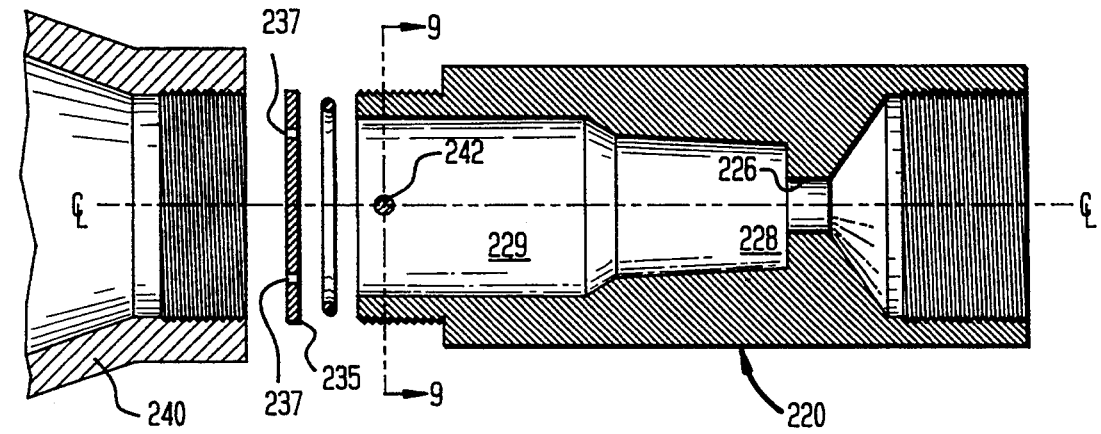
FIG. 8 is a side elevational view similar to FIG. 3 of another form of water/air mixing and distributing device in accordance with the present invention partly in vertical section.
Figure 9:
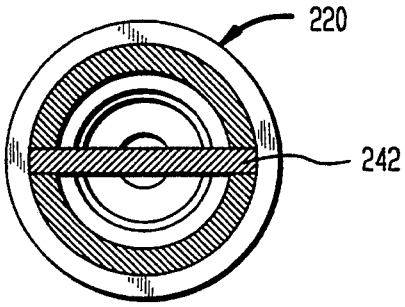
FIG. 9 is a cross-section taken on line 9—9 of FIG. 8.

In addition to the preferred embodiment described above in connection with FIG. 1, another water/air mixing cartridge 220 in accordance with the present invention is shown at FIGS. 8 and 9. The structure is substantially identical to the form of the invention shown in FIGS. 1 to 5 of the drawings and above described with a few structural differences which produce unusual effects and permit the present invention to be applied to many other applications and uses other than as a shower head.

For example, the diameter of entering water inlet 226 of the embodiment of FIG. 6 is larger than the entering water inlet 26 for the form of the invention shown in FIGS. 1 to 5. Specifically, entering water inlet 226 is sized at 0.180" and is also preferably connected with the source of water at 60 psig.

In addition to a larger entering water inlet 226, a small rod 242 extends diametrically across the width and at the lowermost or bottom portion of expansion chamber 229 as close as possible to the partition or closure 235 at the bottom end of the cartridge 220. The rod intersects with and is transverse to the stream of water flowing along the longitudinal centerline for the water/air mixing cartridge 220 as shown at FIGS. 8 and 9 of the drawings.

Preferably, rod 242 is a stainless-steel corrosion resistant pin having a diameter of about 0.0625".

Operation of Second Embodiment

In operation, the embodiment of FIGS. 8 and 9 is similar to the operation of the embodiment of FIG. 1. A stream of entering water is provided at inlet 226 and is projected along the longitudinal axis of water/air mixing cartridge 220 through the mixing chamber 228 and expansion chamber 229 for impingement against the partition 235.

However, because the width of the stream in the embodiment of the present invention shown at FIGS. 8 and 9 is wider than the width of the stream for the form of the invention shown in FIG. 1, and because the water also impinges against rod 242, there is a greater and more violent dispersal of the entering water. This increases the activity of the expanding water/air mixture in expansion chamber 229 with a corresponding increase in activity in mixing chamber 228. Accordingly, the addition of rod 242 results in an extremely fine, pulsating, heavily-aerated powerful mist, which is excellent for rinsing purposes due to the scrubbing effect of the discharging pulsating water/air mixture. This form of the water/air mixing and dispensing device in accordance with the present invention is therefore adapted as a waterconserving device for use on dishes, bottles or the like and in car washing apparatus and systems. The presence of the large inlet hole substantially prevents clogging while preserving the efficiency of this form of the water/air mixing and dispensing devices. It is contemplated that this form of the invention as shown in FIGS. 8 and 9 will use water at a rate of only about 2.5 gallons per minute.

In place of the pin as shown in FIGS. 8 and 9 of the drawings, the cartridge can also be modified by adding a rounded raised centrally located member, not shown, to the inner face of the partition or closure 235 at the bottom end of the cartridge 220, which effectively modifies the pressure condition in the expansion chamber 229 that, like the rod 242, it modifies the characteristics of the water dispensed and adapts the water/air mixing and dispensing device for purposes other than a shower head. Those skilled in the art will readily understand this modification by references to the form of the invention shown at FIGS. 8 and 9 of the drawings.

Figure 10:
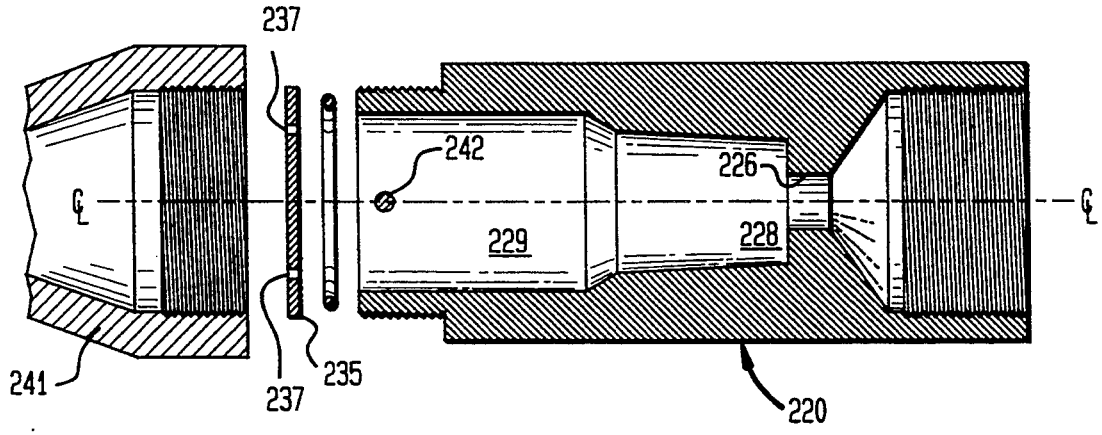
FIG. 10 shows a view of the form of the invention shown in FIG. 8 with a modified flow directing device which permits this embodiment of the water/air mixing and dispensing device to act as a nozzle.

FIG. 8 also shows that a distributing head 240 can be attached to the bottom end of the water/air mixing cartridge 220 to dispense the discharging water/air mixture in a fine spray, or as shown in FIG. 10 a cone-shaped discharging head 241 can be attached to the bottom end of the water/air mixing cartridge 220 to discharge the water/air mixture in a stream as may be required for a particular use such as cleaning bottles, at a car wash service or other application.

Although the invention herein has been described with reference to two particular embodiments, it is to be understood that the embodiments are merely illustrative of the principles and application of the present invention. It therefore will be understood that numerous modifications may be made to the embodiment and that other arrangements may be devised without departing from the spirit and scope of the present invention as defined by the claims.

What is claimed is:

1. A water/air mixing and dispensing device connected to a source of water comprising:

a. housing means having an elongated passage means extending end to end therethrough defining a mixing chamber and an operatively associated expansion chamber in communication with said mixing chamber, b. said mixing chamber having a predetermined size and shape, c. said housing means having a sized inlet orifice at one end of said elongated passage means for continuously delivering a predetermined volume of entering water travelling along the longitudinal axis of said mixing chamber and said expansion chamber, and partition means on said housing means at the end of said elongated passage means remote from said inlet orifice against which said entering water impinges, d. said partition means including a plurality of spaced openings to enable impinging water to draw ambient air into said expansion chamber for mixing with said entering water and for discharging the water/air mixture from said housing means, e. said housing means including, inner wall means for said mixing chamber having a diameter which increases at a generally constant rate with increasing axial distance from said inlet orifice end of said housing means, f. said housing means having flared shoulder means disposed between said mixing chamber and said expansion chamber, and g. said flared shoulder means having a diameter which increases at a generally constant rate from said mixing chamber to said expansion chamber to define a predetermined constant angle with respect to the longitudinal axis of the housing means.

2. The device of claim 1 wherein the inner wall means of said mixing chamber tapers at an angle with respect to the longitudinal axis of the housing means of about 6°.

3. The device of claim 1 wherein the diameter of the inner wall means of said mixing chamber nearest said inlet orifice: the diameter of the inner wall means of said mixing chamber at the intersection of the longitudinal axis with the angle of said flared shoulder means: and the diameter of the walls of said expansion chamber are in a ratio respectively of about 0.300":0.400":0.500" (3:4:5).

4. The device of claim 1 wherein the angle of the wall of said flared shoulder means tapers at an angle with respect to the longitudinal axis the housing means of about 30°.

5. The device of claim 1 wherein the diameter of said inlet orifice is about 0.150", the longitudinal length of said mixing chamber is about 0.625", and the longitudinal length of said expansion chamber is about 0.357".

* * * * *

UNITED STATES PATENT AND TRADEMARK OFFICE

CERTIFICATE OF CORRECTION

PATENT NO. : 5,381,957

DATED : January 17, 1995

INVENTOR(S) : Eric L. Bianco

It is certified that error appears in the above-identified patent and that said Letters Patent is hereby corrected as shown below:

Column 2, line 28, "add" should read —and—.
Column 5, line 34, "base" should read —bore—.
Column 5, line 68, after "Thereafter" insert —,—.
Column 10, line 37, after "axis" insert —of—.

Signed and Sealed this

Sixteenth Day of May, 1995

*Attest:*

*Attesting Officer*

BRUCE LEHMAN

*Commissioner of Patents and Trademarks*